US005562816A

United States Patent [19]

Roling

[11] Patent Number: 5,562,816

[45] Date of Patent: Oct. 8, 1996

[54] TAR DISSOLUTION PROCESS

[75] Inventor: Paul V. Roling, Spring, Tex.

[73] Assignee: Betz Laboratories, Inc., Trevose, Pa.

[21] Appl. No.: 295,310

[22] Filed: Aug. 24, 1994

[51] Int. Cl.[6] ..... C10G 9/16

[52] U.S. Cl. ..... 208/48 R; 208/48 AA; 208/45; 585/950

[58] Field of Search ..... 208/48 R, 48 AA, 208/45; 585/950

[56] References Cited

U.S. PATENT DOCUMENTS

| | | | |
|---|---|---|---|
| 3,985,802 | 10/1976 | Piasek et al. | 260/553 A |
| 4,116,812 | 9/1978 | Godar et al. | 208/48 AA |
| 4,456,454 | 6/1984 | Jenkins, Jr. | 44/73 |
| 4,804,456 | 2/1989 | Forester | 208/48 AA |
| 4,810,354 | 3/1989 | Roling et al. | 208/48 AA |
| 4,927,519 | 5/1990 | Forester et al. | 208/48 AA |
| 5,225,002 | 7/1993 | Stafford et al. | 134/22.14 |
| 5,271,824 | 12/1993 | Forester et al. | 208/48 AA |

*Primary Examiner*—Helane Myers
*Attorney, Agent, or Firm*—Alexander D. Ricci; Philip H. Von Neida

[57] ABSTRACT

A Mannich reaction product of reactants selected from alkylated phenols, a polyamine and an aldehyde is employed to dissolve tar deposits in coke oven piping and transmission lines.

7 Claims, No Drawings

TAR DISSOLUTION PROCESS

FIELD OF THE INVENTION

The present invention relates to processes for dissolving tar and tar-like substances in coke oven pipe and transmission lines.

BACKGROUND OF THE INVENTION

Coking processes are relatively severe cracking operations designed to convert residual hydrocarbon stocks such as vacuum and atmospheric residuals and reduced crudes into gas, naphtha, gas oil and coke.

During these coking processes, gases and vaporized liquids such as tar, light oil and ammonia liquor are produced. These compounds and other higher boiling materials will deposit as tar or tar-like substances on the hot metal surfaces of pipes and transmission lines that carry the effluent gases to other parts of the coking unit. This tar or tar-like substance becomes coke-like as it forms deposits and will ultimately plug the pipe or transmission line. The resulting pluggage results in poor flow and necessarily needs to be removed or cleaned so as to continue efficient operation of the coking process. This cleaning often results in the shut-down of the coker oven.

The present inventor has discovered that certain Mannich reaction products will dissolve this tar and inhibit plugging of the pipes and transmission lines so as to keep the pipelines flowing freely without the need for costly shut-down for cleaning.

DESCRIPTION OF THE RELATED ART

U.S. Pat. No. 5,225,002 teaches the use of N-methyl-2-pyrrolidone as a solvent for cleaning gas lines in coke oven batteries. This compound is particularly effective when employed with an aromatic naphtha, and a polymeric dispersant.

DETAILED DESCRIPTION OF THE INVENTION

The present invention provides for methods for dissolving tar deposits in coke oven piping and transmission lines comprising adding to said piping and transmission lines an effective tar dissolving amount of a Mannich reaction product.

The Mannich reaction product is formed by reaction of reactants (A), (B) and (C); wherein (A) is an alkyl substituted phenol of the structure:

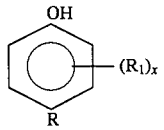

wherein R and $R_1$ are the same or different and are independently selected from alkyl, aryl, alkaryl, or aralkyl of from 1 to about 20 carbon atoms, x is 0 or 1; wherein (B) is a polyamine of the structure:

$$H_2N(\underset{\underset{R_2}{|}}{CH}-(CH_2)_y-\underset{\underset{R_3}{|}}{CH}-NH)_z-H$$

wherein z is a positive integer, $R_2$ and $R_3$ may be the same or different and are independently selected from H, alkyl, aryl, aralkyl, or alkaryl having from 1 to about 20 carbon atoms, y is 0 or 1; and wherein (C) is an aldehyde of the structure:

$$R_4-\overset{\overset{O}{||}}{C}-H$$

wherein $R_4$ is selected from H and an alkyl having from 1 to about 6 carbon atoms.

The alkyl substituted phenol may be selected from the group including but not limited to p-cresol, 4-ethylphenol, 4-t-butylphenol, 4-t-amylphenol, 4-t-octylphenol, 4-dodecylphenol, 2,4-di-t-butylphenol, 2,4 -di-t-amylphenol, and 4-nonylphenol. The preferred alkyl substituted phenol is 4-nonylphenol.

The polyamine may be selected from the group including but not limited to ethylenediamine, propylene diamine, diethylene triamine, triethylene tetramine, tetraethylene pentamine with ethylenediamine being preferred.

The aldehyde may be selected from the group including but not limited to formaldehyde, acetaldehyde, propanaldehyde, butyraldehyde, hexaldehyde and heptaldehyde. The preferred aldehyde is formaldehyde in its monomeric form or, more conveniently, in its polymeric form (i.e., paraformaldehyde).

As is conventional in the art, the condensation reaction may proceed at temperatures from about 50° to 200° C. with a preferred temperature range being about 75° to 175° C. As is stated in U.S. Pat. No. 4,166,726, the time required for completion of the reaction usually varies from about 1 to 8 hours, varying of course with the specific reactants chosen and the reaction temperature.

The molar range of the components (A):(B):(C) which may be used is in the range 0.5–5:1:0.5–5. A preferred embodiment (A):(B):(C) is p-nonylphenol:ethylenediamine:paraformaldehyde in a 2:1:2 molar ratio of components. Various examples of this Mannich reaction product are described in U.S. Pat. No. 4,749,468, the contents of which are wholly incorporated by disclosure herein.

As used in the processes of the present invention, the term "tar" can be defined as a thick brown to black carbonaceous liquid residue. On standing at near ambient temperatures, the tar turns harder and more coke-like in nature.

The Mannich reaction product is preferably fed to the location experiencing tar deposits or plugging. However, the addition point should be one where the Mannich reaction product readily reaches the point where tars are depositing. This addition point can be determined given the nature of the tar deposit and physical constraints of the pipeline sought to be treated. One advantage of the present invention is that the Mannich reaction product will remain liquid at temperatures roughly equal to that of typical pipeline temperatures (≈155° F.). This allows the Mannich reaction product to remain at the tar deposit and provide a medium for the tar to dissolve in. It is anticipated that the Mannich reaction product will efficaciously dissolve tar at temperatures ranging from ambient temperatures to about 300° F.

The Mannich reaction product of the present invention is preferably added to the tar in a suitable liquid carrier or solvent. The Mannich reaction product is preferably dissolved in aromatic hydrocarbon solvents which include, but are not limited to, xylene and heavy aromatic naphtha.

The treatment dosage for the Mannich reaction product depends upon the severity of the tar deposit, location of the tar deposit and amount of active in the blended product. Heavier deposits and/or completely plugged pipelines will generally require larger dosages of the Mannich reaction product.

Preferably, the total amount of Mannich reaction product added to the tar ranges from 1 part Mannich reaction product to 1 part tar to 25 parts Mannich reaction product to about 1 part tar.

The invention will now be further described with reference to a number of specific examples which are to be regarded solely as illustrative, and not as restricting the scope of the invention.

EXAMPLES

Hardened tar (0.50 g) was placed in a test-tube along with 10 mL of the solvent and the mixture was heated at 155° F. for about 18 hours. The appearance of the solution was noted and the amount of hardened tar was determined by filtering the solution, washing the hardened tar with xylene to remove any remaining solvent, drying, and weighing. Testing was also performed using DMF and sulfolane for comparison. These testing results are presented in Table I.

TABLE I

| Treatment | Dosage (mL) | Coke Dissolved (g) |
|---|---|---|
| NP-EDA-PF | 2.5[1] | 0.27[2] |
| NP-EDA-PF | 2.5[1] | 0.11[2] |
| DMF | 10 | none |
| Sulfolane | 10 | none |

NP-EDA-PF is the Mannich Reaction Product of p-nonylphenol (NP): ethylenediamine (EDA):paraformaldehyde (PF) in a molar ratio of 2:1:2.
[1]in 7.5 mL heavy aromatic naphtha.
[2]some solids remained undissolved, but were free flowing.

This testing shows that the Mannich reaction product of the present invention is effective at dissolving tar while other solvents, N,N-dimethylformamide (DMF) and sulfolane proved ineffective.

The Mannich reaction product dissolved in a heavy aromatic was fed to a Northeast steel plant at a rate of 6 to 10 gallons per day for 18 weeks. The dripleg was emptied 3 times a day and plugging of the pipe did not occur until the 14th week when, due to severe weather, the dripleg was not drained on a regular basis.

Upon leaving the dripleg open for about a day, the Mannich reaction product slowly moved the tars down the dripleg until the line was again free. Without addition of the Mannich product, the pipeline would typically plug in a week or less. This indicates that the Mannich reaction product works effectively at inhibiting tar deposit buildup but will also dissolve tar that is present in amounts sufficient to plug pipe and transmission lines. Thus the Mannich reaction product provides efficacy at both inhibiting deposits during production but also to dissolve buildups that necessitate production shut-down.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what I claim is:

1. A method for dissolving already formed tar deposits in coke oven piping and transmission lines having a temperature from ambient to about 300° F. comprising adding an effective dissolving amount of a Mannich reaction product formed by reaction of reactants (A), (B), and (C), wherein (A) comprises an alkyl substituted phenol of the structure:

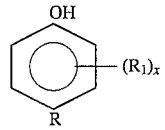

wherein R and $R_1$ are the same or different and are independently selected from alkyl, aryl, alkaryl, or aralkyl of from 1 to about 20 carbon atoms, x is 0 or 1; (B) comprises a polyamine of the structure:

$$H_2N(\underset{\underset{R_2}{|}}{CH}-(CH_2)_y-\underset{\underset{R_3}{|}}{CH}-NH)_z-H$$

wherein z is a positive integer, $R_2$ and $R_3$ may be the same or different and are independently selected from H, alkyl, aryl, aralkyl, or alkaryl having from 1 to about 20 carbon atoms, y is 0 to 1; and (C) comprising an aldehyde of the structure:

$$R_4-\overset{\overset{O}{||}}{C}-H$$

wherein $R_4$ comprises H or $C_1$ to $C_6$ alkyl.

2. The method as claimed in claim 1 wherein the molar ratio of reactants (A):(B):(C) being 0.5 to 5:1:0.5 to 5.

3. The method as claimed in claim 1 wherein said Mannich reaction product is added to said tar in an amount ranging from 1 part Mannich reaction product to 1 part tar to 25 parts Mannich reaction product to about 1 part tar.

4. The method as claimed in claim 1 wherein (A) is selected from the group consisting of p-cresol, 4-ethylphenol, 4-t-butylphenol, 4-t-amylphenol, 4-t-octylphenol, 4-dodecylphenol, 2,4-di-t-butylphenol, 2,4 -di-t-amylphenol, and 4-nonylphenol.

5. The method as claimed in claim 1 wherein (B) is selected from the group consisting of ethylenediamine and triethylenetetramine.

6. The method as claimed in claim 1 wherein (C) is selected from the group consisting of formaldehyde and paraformaldehyde.

7. The method as claimed in claim 1 wherein said Mannich reaction product is dissolved in an aromatic hydrocarbon solvent.

* * * * *